United States Patent [19]

Funabashi et al.

[11] Patent Number: 4,543,085

[45] Date of Patent: Sep. 24, 1985

[54] APPARATUS FOR SEPARATING SOLID MATTERS

[75] Inventors: Kiyomi Funabashi, Katsuta; Fumio Kawamura; Toshio Takagi, both of Hitachi; Megumu Urata, Naka; Tetsuo Fukasawa, Hitachi, all of Japan

[73] Assignee: Hitachi, Ltd., Tokyo, Japan

[21] Appl. No.: 461,916

[22] Filed: Jan. 28, 1983

[30] Foreign Application Priority Data

Feb. 5, 1982 [JP] Japan ..... 57-17959

[51] Int. Cl.[4] ..... B04B 11/08

[52] U.S. Cl. ..... 494/30; 494/36; 494/37; 494/57

[58] Field of Search ..... 210/190, 269, 660; 137/544–549; 494/27, 29, 30, 35, 36, 37, 42, 44, 56, 57, 58, 59

[56] References Cited

U.S. PATENT DOCUMENTS

| | | | |
|---|---|---|---|
| 461,671 | 10/1891 | Folsche | 494/36 |
| 1,012,097 | 12/1911 | Peck | 494/29 |
| 2,321,887 | 6/1943 | Ayers | 494/27 |
| 3,309,015 | 3/1967 | Jung | 494/58 |
| 3,779,450 | 12/1973 | Shapiro | 494/57 |

*Primary Examiner*—Robert W. Jenkins
*Assistant Examiner*—Arthur D. Dahlberg
*Attorney, Agent, or Firm*—Beall Law Offices

[57] ABSTRACT

An apparatus for separating solid matters having a rotor of a double-basket construction consisting of a centrifugal filtering basket which is secured in a basket which effects the separation relying upon the difference in specific gravity. A pipe is so arranged as to supply the liquid to be treated into the centrifugal filtering basket, and scoop pipes are arrayed near the side surfaces of the two baskets.

12 Claims, 5 Drawing Figures

APPARATUS FOR SEPARATING SOLID MATTERS

BACKGROUND OF THE INVENTION

1. Field of the Invention:

The present invention relates to an apparatus for separating solid matter, and more particularly to a batch-type centrifugal separator which is suited for separating solid matter from one another utilizing the difference in specific gravities.

2. Description of the Prior Art:

Batch-type centrifugal separators have been extensively used as means for separating solid matter from liquids or for separating solid matter from one another. The separators of this type have been based upon either the centrifugal sedimentation method or the centrifugal filtration method. First, these conventional techniques will be described below.

FIG. 1 is a section view of a sedimentation-type centrifugal separator, in which reference numeral 1 denotes an upper end plate of a rotor of the centrifugal separator, 2 denotes a non-perforated hollow cylindrical member, 3 denotes a lower end plate, 4 denotes a drive shaft, 5 denotes a liquid discharge pipe, 6 denotes a liquid discharge pipe driving device, 7 denotes a supply pipe, 8 denotes a scraper, 9 denotes a device for driving the scraper up and down, 10 denotes a device for driving the scraper in the horizontal direction, 11 denotes a solid discharge port, and 12 denotes a fixing rod. Symbols A and B represent a solid matter and a liquid, respectively.

The upper end plate 1 and the lower end plate 3 are united with the hollow non-perforated cylinder 2 to form a rotor as a unitary structure. The drive shaft 4 is connected at its one end to the lower end plate 3 through a plurality of fixing rods 12 and is connected at its other end to a motor which is not shown. The liquid discharge pipe driving device 6, supply pipe 7 and the drive device 10 for driving the scraper in the horizontal direction are fixed to an outer casing which is not shown.

In operation, the liquid discharging pipe 5 and the scraper 8 are moved so as not to come in contact with the liquid surface, and the motor is started to transmit the rotational force of the motor to the rotor through the drive shaft 4. Then, a slurry which is a mixture of the solid matter A and the liquid B is supplied through the supply pipe 7. When the solid matter A has a greater specific gravity than the liquid B, the solid matter A moves toward the outer peripheral region and the liquid B moves toward the inner peripheral region as illustrated. If there is any solid matter having a specific gravity smaller than the liquid B, such a matter moves to the innermost region inside the region of the liquid B. Thereafter, the liquid B is discharged while the liquid discharge pipe 5 gradually moves toward the outer periphery by the operation of the driving device 6. In this case, solid matter having specific gravities smaller than that of the liquid B are discharged together with the liquid B. After the completion of the discharge of the liquid B, the rotor is decelerated and the scraper 8 is moved toward the outer periphery by the horizontally driving device 9 while being moved up and down by the operation of the driving device 10, thereby to scrape the solid matter A. The solid matter is discharged by the force of gravity through the solid discharging port 11.

This sedimentation-type centrifugal separator, however, cannot completely collect the liquid content in the solid matter, although it can make solid-liquid separation and solid-solid separation by the difference in specific gravities. In the case of a liquid other than water, therefore, the solid matter must be washed using another device.

FIG. 2 is a section view of a filtration-type centrifugal separator, in which reference numeral 13 denotes a washing pipe, and 14 designates a hollow perforated cylinder. Other portions are identical to those shown in FIG. 1. These identical portions are designated by corresponding reference numerals and detailed description of such portions is omitted. The washing pipe 13 is fixed to the outer casing together with the supply pipe 7 and a horizontal scraper driving device 10. This filtration-type separator differs from the sedimentation-type separator explained before in that it does not have the liquid discharge pipe 5 and the liquid B is allowed to be discharged to the outside of the rotor through the perforations of the perforated hollow cylinder 14 regardless of the specific gravities of the liquid B and the solid matter A. In addition, it is possible to wash the solid matter A by using the washing pipe 13.

This filtration-type separator, however, cannot hold the liquid B in the rotor, and cannot effect the solid-solid separation by the difference in specific gravities.

SUMMARY OF THE INVENTION

With the conventional batch-type centrifugal separators as mentioned above, it is not possible to perform a series of separating operations such as solid-solid separation, washing and the like in a single apparatus. That is, many other additional devices such as receiving tanks must be provided requiring laborious work for treating the slurry that may clog the conduits as it flows therethrough.

In view of the above-mentioned circumstances, the object of the present invention is to provide a double-structure centrifugal separator which is capable of working both as a sedimentation-type centrifugal separator and as a filtration-type centrifugal separator.

The gist of the present invention resides in a centrifugal separator having a rotor which comprises an outer vessel having a non-perforated hollow cylindrical member and non-perforated end plates attached to the upper and lower ends of the cylindrical member, and an inner vessel having a perforated hollow cylindrical member mounted in the outer vessel coaxially therewith and non-perforated end plates attached to the upper and lower ends of a perforated hollow cylindrical member.

DESCRIPTION OF THE PREFERRED EMBODIMENT

Figure 1:
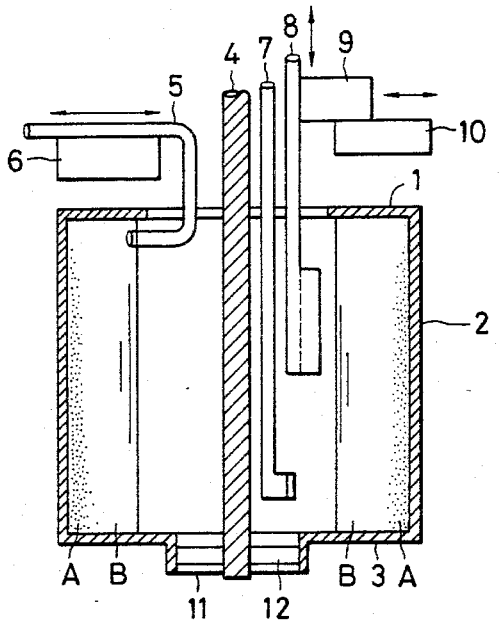
FIG. 1 is a cross-sectional view of a conventional sedimentation-type centrifugal separator.
Figure 2:
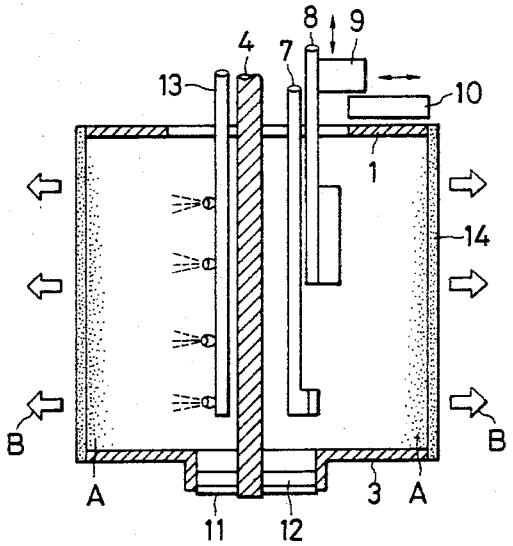
FIG. 2 is a cross-sectional view of a conventional filtration-type centrifugal separator.
Figure 3:
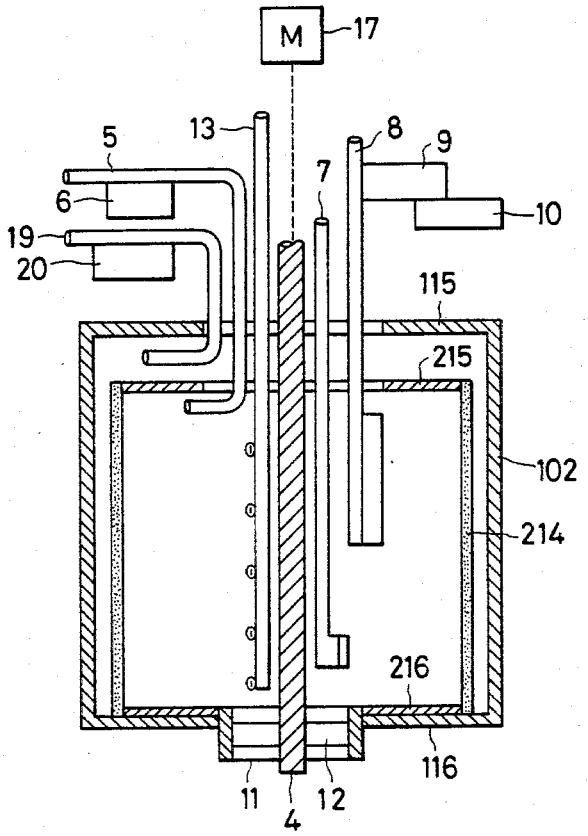
FIG. 3 is a cross-sectional view of a double-structure centrifugal separator in accordance with an embodiment of the invention.

FIG. 3 is a section view illustrating a centrifugal separator according to an embodiment of the present invention, in which an outer vessel 100 consists of a hollow non-perforated cylinder 102, an upper end plate 115 and a lower end plate 116. An inner vessel 200 consists of a hollow perforated cylinder 214, an upper end plate 215, and a lower end plate 216. The outer vessel 100 and the inner vessel 200 are secured together via a fixing rod 12 with the drive shaft 4 as a center. The drive shaft 4 is connected to a motor 17. The liquid discharge pipe 5, the pipe 7 for supplying a liquid to be treated, the scraper 8, and a washing pipe 13 are inserted into the inner vessel 200 from the upper direction thereof, and a pipe 19 for discharging the filtrate is inserted in the outer vessel 100 from the upper direction thereof. The liquid discharge pipe 5 is moved in the horizontal direction by the liquid discharge pipe driving device 6, and the filtrate discharge pipe 19 is moved in the horizontal direction by a filtrate discharge pipe driving device 20. Further, the scraper 8 is driven in the circumferential direction by a horizontally driving device 9 and is further driven in the upper and lower directions by a vertically driving device 10. The driving devices 6, 20, washing pipe 13, supply pipe 7, and vertically driving device 10 are fixed to an outer casing which is not shown. Further, a solid discharge port 11 is formed in the lower central portions of the outer vessel 100 and the inner vessel 200.

Three operations will be described below, i.e., solid-solid separation relying upon the difference in specific gravities, discharge of the separated liquid and washing, and discharge of solid matter, using the above-mentioned apparatus. As a preparatory operation, the liquid discharge pipe 5, filtrate discharge pipe 19 and scraper 8 are moved radially inwardly by the driving devices 6, 20 and 9 so as not to come into contact with the liquid surface. Then, the motor is started to transmit the rotational force to the rotor through the drive shaft 4. The following operations are effected when the rotor is accelerated to a speed of about 1500 rpm.

First, the filtrate discharge pipe 9 is so moved that its end is located at the outer peripheral region of the perforated hollow cylindrical member 14, and the slurry which is a mixture of a solid matter and a liquid to be separated from each other is supplied through the supply pipe 7. The liquid in the slurry is collected in the outer vessel through the perforations of the perforated hollow cylindrical member 14, and is discharged through the filtrate discharge pipe 19. Then, the filtrate discharge pipe 19 is moved toward the inner periphery while keeping the end of this pipe away from the liquid surface (the liquid level at the time of maximum liquid supply), and a separation liquid having a specific gravity midway between two solid matters to be separated is supplied through the supply pipe 7. Then, while continuing the supply of the separation liquid, the liquid discharge pipe 5 is moved toward the outer peripheral region to discharge the separation liquid and the solid matter having a small specific gravity through the liquid discharge pipe 5. After the completion of the discharge, the liquid discharge pipe 5 is moved back to the position where it does not come into contact with the liquid surface even under the condition of maximum liquid supply.

Then, the residual separation liquid is discharged. In this case, the filtrate discharge pipe 19 is gradually moved to the outer peripheral region while continuously rotating the rotor thereby to discharge the residual separation liquid through the filtrate discharge pipe 19. This operation is continued until the filtrate discharge pipe 19 is moved to the outermost position.

The washing operation is then started. The washing operation is made by spraying pure water or the like from the washing pipe 13 while keeping the filtrate discharge pipe 19 at the outermost position. The water after the washing is discharged through the filtrate discharge pipe 19.

Then, the solid matter is discharged. For this purpose, the rotor is decelerated from 1500 rpm down to 10 rpm or so, and the scraper 8 is introduced into the inner vessel thereby to scrape off the solid matter. The scraped solid matter then drops by the force of gravity through the solid discharge port 11.

As will be understood from the foregoing description, the double-structure centrifugal separator of the invention can perform a series of operations including the solid-solid separation, washing and so forth within the separator.

Figure 4:
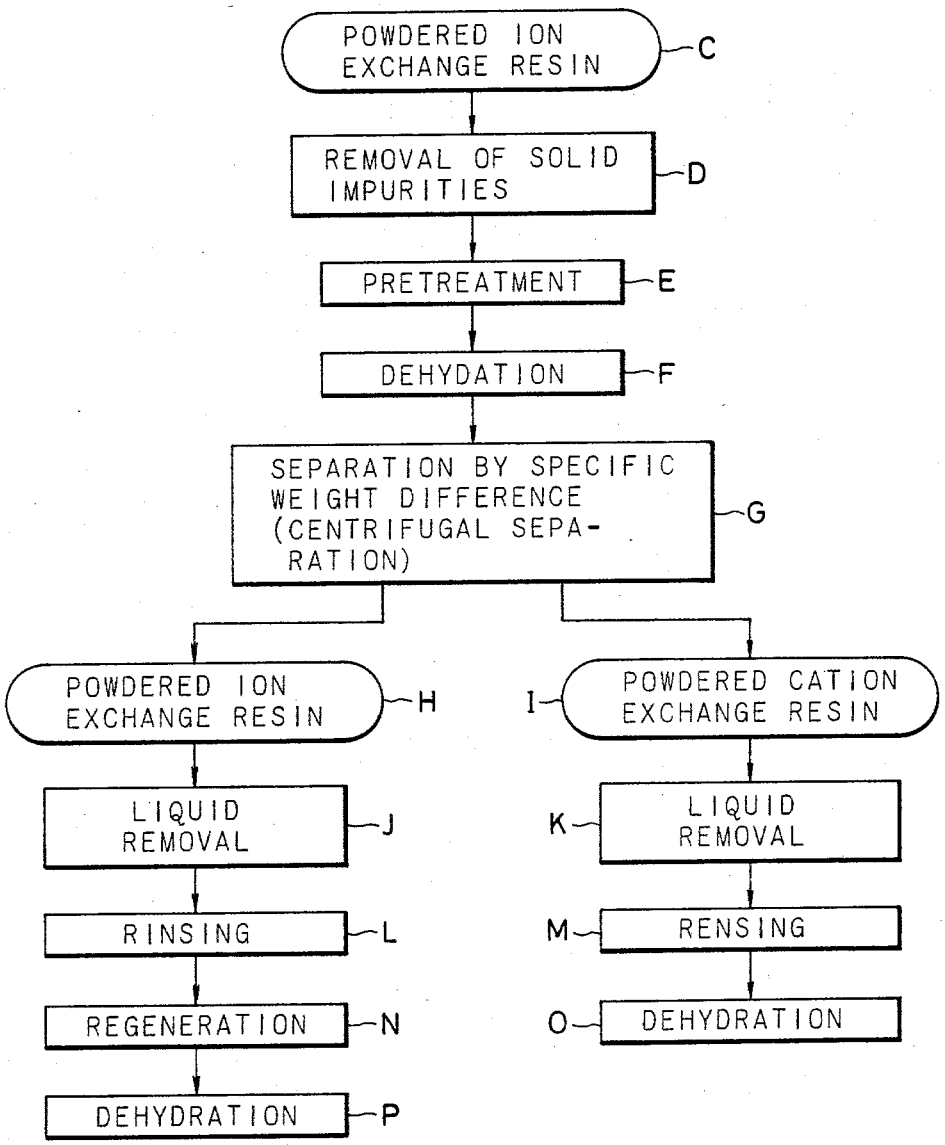
FIG. 4 is a flow chart of a treatment for regenerating powdered ion exchange resin which is used as a filtration assisting agent.

An explanation will be made hereinafter as to the effect of the double-structure centrifugal separator in accordance with the invention, with specific reference to FIGS. 4 and 5. FIG. 4 is a flow chart of a treatment for regenerating powdered ion exchange resin which is used as the filtration assisting agent. Solid impurities are adhered to the powdered ion exchange resin C after it has been used. The regeneration of the ion exchange resin includes removal of impurities by the ultrasonic waves (D) and a pretreatment in which the resin is immersed in a dilute NaOH solution (E). The pretreatment is conducted because, in the subsequent step (G) of separation by the difference in specific gravities, 20% by weight of NaOH solution effectively serves as the separating agent, and because it is the ion exchange resin that is to be separated and that must be chemically formalized. Thereafter, the dehydration (F) is conducted to prevent the 20 wt % NaOH solution from being diluted which will be used in the subsequent step. Then, the ion exchange resin is immersed in the 20 wt % NaOH solution to separate the powdery cation exchange resin and powdery anion exchange ion from each other based upon the difference in specific gravities (G). The powdery anion exchange resin, the 20 wt % NaOH and the powdery cation exchange resin have specific gravities which increase in the order mentioned. Therefore, the powdery anion exchange resin I floats while the powdery cation exchange resin H precipitates. If the separation is effected by centrifuge, the separation efficiency can be increased (70–80%), and the separation can be effected within reduced periods of time.

Then, dehydrating steps (J) and (K) are effected to recover the liquid from the powdery cation and anion exchange resins H and I. These steps are effective not only to reduce the consumption of the separation liquid but also to facilitate subsequent rinsing steps (L) and (M). Then, the rinsing steps (L) and (M) are effected and the liquid after the rinsing is reused as the pretreating solution. The powdery anion exchange resin I, which is used as OH type, is then dehydrated (O) and is reused. The powdery cation exchange resin H, which is of Na type, is regenerated (N) into the chemical form H with sulfuric acid. Then, the dehydration (P) is conducted following the rinsing, and the resin is reused.

If the liquid removal and dehydration in the series of operations explained above are conducted by using centrifugal separators, a total of six separators are necessary, and additional devices must also be used. Further, transfer of slurry and solid matter may give rise to the occurrence of clogging in the conditions.

Figure 5:
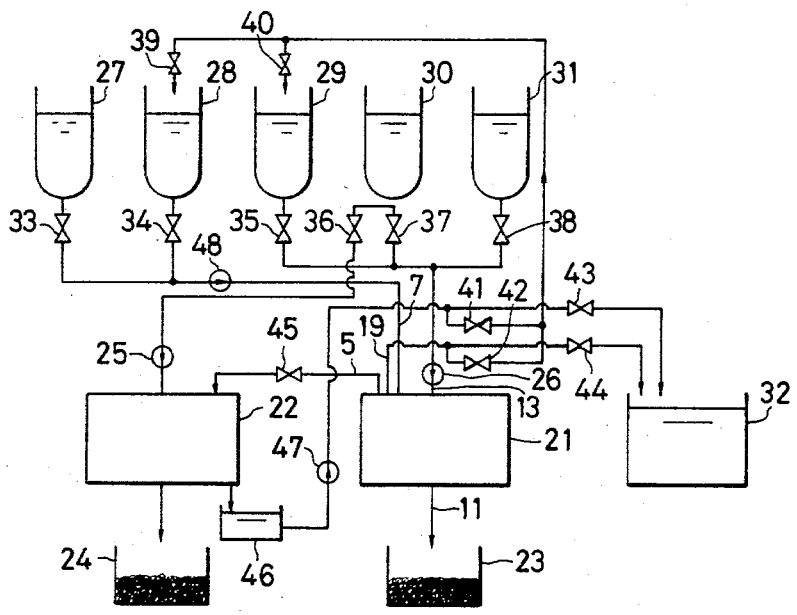
FIG. 5 is a diagram of a system for conducting the treatment shown in FIG. 4 by using the double-structure centrifugal separator of the invention.

FIG. 5 is diagram of a system for carrying out the treatment using the centrifugal separator of the present invention. In FIG. 5, reference numeral 21 designates a centrifugal separator in accordance with the invention, 22 denotes a conventional centrifugal filtering device, 23 denotes a tank for receiving regenerated powdery cation exchange resin, 24 denotes a tank for receiving regenerated powdery anion exchange resin, 25, 26, 47 and 48 denote pumps, 27 denotes a tank for supplying used powdery ion exchange resin after the removal of the solid matter, 28 denotes a tank for storing separation liquid, 29 denotes a tank for storing pretreating solution, 30 denotes a tank for storing washing water, 31 denotes a tank for storing regenerated liquid, 32 denotes a tank for storing waste liquid, 35 to 45 denote valves and 46 denotes a tank for storing filtrate. The tank 27 for supplying the used powdery ion exchange resin and the separation liquid tank 28 are connected to the supply pipe 7 of the centrifugal separator 21 through valves 33, 34 and the pump 48. The pretreating solution tank 29, washing water tank 30 and the regenerated liquid tank 31 are connected to the washing pipe 13 of the centrifugal separator 21 through valves 35, 37, 38 and the pump 26. The filtrate discharge pipe 19 of the centrifugal separator 21 is connected to the waste liquid receiving tank 32 through the valve 44, and is further connected to the separation liquid tank 28 through the valves 42 and 39, as well as to the pretreating solution tank 29 through valves 42 and 40. The liquid discharge pipe 5 of the centrifugal separator 21 is connected to the supply pipe of the centrifugal filtering device 22 through the valve 45. The liquids discharged from the liquid discharge pipe 5 and the filtrate discharge pipe 19 have water heads of several meters, and the lines connected to these pipes need no pump. The tank 23 for regenerated powdery cation exchange resin is disposed just beneath the solid discharge port 11 of the centrifugal separator 21. The washing water tank 30 is connected also to the washing pipe of the centrifugal filtering device 22 through the valve 36 and the pump 25. Therefore, filtrate is allowed to flow into the filtrate receiving tank 46 through the port provided at the bottom of the external casing. The filtrate receiving tank 46 is connected to the wast liquid receiving tank 32 through the pump 47 and valve 43 and also to the separation liquid tank 28 through valves 41, 39, as well as to the pretreatment solution tank 29 through the valves 41 and 40. The regenerated powdery anion exchange resin receiving tank 24 is disposed just under the solid discharge port of the centrifugal filtration device 22.

The separating operation will be explained hereinafter in accordance with the sequence of operation. The used powdery ion exchange resin is temporarily stored in the supply tank 27 in the form of slurry. The resin is then supplied into the centrifugal separator 21. The filtrate from the separator 21 is thrown into the waste liquid tank 32. Then, the pretreatment solution is supplied into the centrifugal separator 21 from the pretreatment solution tank 29, and the waste liquid is discharged to the waste liquid tank 32. After the pretreatment solution has been sufficiently dehydrated, the separation liquid is supplied from the separation liquid tank 28 to fill the rotor of the centrifugal separator 21 thereby to effect the separation relying upon the difference in specific gravities. In this separating operation, the powdery anion exchange resin having a small specific gravity is fed to the centrifugal filtering device 22 together with portion of the separation liquid. Then, the liquid is removed by the centrifugal separator 21 and the centrifugal filtering device 22. The separation liquid thus collected is returned to the separation liquid tank 28 and, thereafter, the washing water is supplied to the separator 21 and to the filtering device 22 from the washing liquid tank 30 thereby to wash the separator 21 and the filtering device 22. The water after the washing is returned to the pretreatment solution tank 29 for use as the pretreatment solution. The powdery anion exchange resin in the centrifugal filtering device 22 is scraped off and is stored in the regenerated powdery anion exchange resin receiving tank 24. On the other hand, the regenerating liquid is supplied from the regenerating liquid tank 31 to the centrifugal separator 21 thereby to regenerate the powdery cation exchange resin in the separator 21. Then, washing water is supplied from the washing water tank 30 followed by the dehydration. The waste liquids produced through the regeneration are sent to the waste liquid tank 32. Thereafter, the powdery cation exchange resin in the centrifugal separator 21 is scraped off and is stored in the regenerated powdery cation exchange resin tank 23. The powdery ion exchange resin is thus regenerated.

According to the present invention as described above, the processing which had hitherto been conducted by using six centrifugal separators, can be carried out using a total of only two centrifugal separators, i.e., using a centrifugal separator constructed according to the present invention and an existing centrifugal filtering device. Therefore, the slurry needs be transported over reduced distances, and the processing can be completed within reduced periods of time.

In the embodiment shown in FIG. 3, the solid matter having small specific gravities are discharged through the liquid discharge pipe 6. The solid matter having small specific gravities, however, may be discharged in other ways. That is, the separation maybe allowed to flow continuously from the supply pipe 7 so that, the separation liquid containing solid matters with small specific gravities is allowed to overflow from the rotor, to be recovered by an external casing.

What is claimed is:

1. An apparatus for separating used powdery ion exchange resins comprising:

an outer vessel including a non-perforated cylindrical member having upper and lower end plates, with each plate having an opening at its central portion;

an inner vessel including a perforated cylindrical member having upper and lower end plates, said inner vessel being concentrically disposed within and radially spaced from said outer vessel to form therebetween an annular space, and said upper and lower end plates each having an opening at its central portion;

a drive shaft coaxially and drivingly connected to each of said inner and outer vessels;

means for rotating said drive shaft, and said inner and outer vessels about their common generally vertical axis;

filtrate discharge means extending through at least one of said openings, and having an inlet and extending near to the inside of the cylindrical member of the outer vessel for receiving filtrate from said annular space;

supplying liquid means for supplying liquid that is to be treated, during rotation of said vessels extending into the inner vessel through said openings, and having a discharge end in said inner vessel below the top of said inner vessel;

liquid and floating solid matter discharge means extending through said openings, and having an inlet end extending near to the inside and top of the cylindrical member of the inner vessel;

precipitated solid matter discharge means provided in the lower portion of the inner vessel for discharging solid matter from said inner vessel through the openings of said inner and outer vessel lower plates a plurality of valves;

tank means for supplying used powdery ion exchange resins;

said filtrate discharge means having a discharge end;

tank means for receiving through one of said valves waste liquid from the discharge end of said filtrate discharge means;

separate tank means for storing a separated liquid and for receiving through a second one of said valves liquid from said discharge end of said filtrate discharge means;

a separate tank for storing a pre-treatment liquid and receiving through a third one of said valves liquid from said discharge end of said filtrate discharge means;

said supplying liquid means being connected to said tank means for supplying the used powdery ion exchange means and to said tank means for storing the separated liquid;

separate centrifugal filtering means for separating the liquid supply from said liquid discharge means into regenerated powdery anion exchange resins and waste liquid;

said liquid discharge means being connected to said separate centrifugal filtering device for supplying liquid thereto;

said solid matter discharge means removing regenerated powdery cation exchange resin from said inner vessel; and washing liquid supply means extending into said inner vessel and supplying liquid from said tank means for storing pretreatment solution, from said washing water tank means and from said regenerated water tank means into said inner vessel through, respectively, a plurality of said valves.

2. An apparatus according to claim 1, wherein the filtrate discharge means and the liquid discharge means are, respectively, provided with means for moving them in the radial direction of the vessel.

3. An apparatus according to claim 2, further including scraping means for scraping solids from the inside surface of the cylindrical member of said inner vessel, said scraping means extending through one of said openings of said inner vessel into said inner vessel and being provided with means for moving said scraping means in the radial direction of the inner vessel.

4. An apparatus according to claim 3, wherein each of said filtrate discharge means, supplying liquid means, liquid discharge means extend through the upper end plate openings of their respective vessels only, and further including means providing the only driving connection between said vessels and said shaft being located at the lower ends of said vessels.

5. An apparatus according to claim 1, further including scraping means for scraping solids from the inside surface of the cylindrical member of said inner vessel, said scraping means extending through one of said openings of said inner vessel into said inner vessel and being provided with means for moving said scraping means in the radial direction of the inner vessel.

6. An apparatus according to claim 5, wherein each of said filtrate discharge means, supplying liquid means, liquid discharge means extend through the upper end plate openings of their respective vessels only, and further including means providing the only driving connection between said vessels and said shaft being located at the lower ends of said vessels.

7. An apparatus according to claim 1, wherein each of said filtrate discharge means, supplying liquid means, liquid discharge means extend through the upper end plate openings of their respective vessels only, and further including means providing the only driving connection between said vessels and said shaft being located at the lower ends of said vessels.

8. A method for regenerating ion exchange resins, comprising the steps of:

using an ion exchange resin powder and thereafter withdrawing the used ion exchange resin for regeneration;

forming a slurry of the withdrawn used ion exchange resin;

supplying the slurry into a rotating centrifugal porous separator vessel;

while continuing to rotate the vessel, passing the slurry liquid through the vessel by centrifugal force and withdrawing the thus-formed filtrate to leave dehydrated ion-exchange resin within said vessel;

supplying a pre-treatment solution into said porous vessel to pretreat the resin and passing the liquid of the pre-treatment solution through the porous vessel by centrifugal action and withdrawing the thus-formed filtrate to again dehydrate the resin after the pretreatment;

thereafter supplying a separating liquid within said porous vessel while surrounding said porous vessel with an imperforate vessel concentric with and rotating with said porous vessel so as to maintain an annular quantity of rotating slurry commonly within said vessels a period of time sufficient to pass separating liquid into the outer vessel to fill the same to the same radial depth as the inner vessel, concentrate solids having a specific gravity greater the separating liquid along the interior surface of said perforate vessel and concentrate the solids having a specific gravity less than the separating liquid along the top innermost portion of only the liquid within the inner perforate vessel;

while continuing to carry out said rotating and maintaining, simultaneously withdrawing some of the separating liquid and the solids of smaller specific gravity from said innermost portion and passing only the withdrawn separating liquid and solids of smaller specific gravity to a separate separator for the steps of separating the solids of smaller specific gravity and separating liquid are performed;

dehydrating the remaining resin within said inner perforate vessel by passing the separating liquid through said perforate vessel and withdrawing the separating liquid from said imperforate vessel; and thereafter scraping the dehydrated solids from the inner surface of said inner perforate vessel and removing said solids from said inner perforate vessel.

9. The method according to claim 8, wherein said ion exchange resin includes anion exchange resin generally of one specific gravity and cation exchange resin generally of a separate different specific gravity; and supplying said separating liquid at a specific gravity between the specific gravity of said cation exchange resin and said anion exchange resin.

10. The method according to claim 9, wherein said steps of supplying a treating solution and dehydrating thereafter include in sequence supplying a pretreating solution, dehydrating, supplying a regenerating liquid, and dehydrating.

11. The method of claim 10, wherein the filtrate withdrawn from said vessels is recycled as separating liquid and pretreating liquid.

12. The method of claim 8, further including the step of recycling at least some of the filtrate from the vessels as separating liquid.

* * * * *